United States Patent [19]

Cruz et al.

[11] 4,103,615

[45] Aug. 1, 1978

[54] VERTICAL ROTARY SCREEN PRINTING MACHINE AND INK SUPPLY THEREFORE

[75] Inventors: Edmundo Novas Cruz; Alvaro Neff Valadares, both of Lisbon, Portugal

[73] Assignee: Sir James Farmer Norton & Co., Limited, Salford, England

[21] Appl. No.: 709,736

[22] Filed: Jul. 29, 1976

[30] Foreign Application Priority Data

Jan. 14, 1976 [PT] Portugal ..... 64693
May 25, 1976 [GB] United Kingdom ..... 21574/76

[51] Int. Cl.[2] ..... B41F 15/44

[52] U.S. Cl. ..... 101/120; 101/115; 101/128.1

[58] Field of Search ..... 101/115, 116, 119, 120, 101/126, 181, 128.1, 123, 124

[56] References Cited

U.S. PATENT DOCUMENTS

| | | | |
|---|---|---|---|
| 2,753,794 | 7/1956 | Groak | 101/116 X |
| 3,232,224 | 2/1966 | Kramer | 101/120 |
| 3,398,680 | 8/1968 | Moskowitz | 101/115 |
| 3,601,350 | 9/1971 | Rosenstadt | 101/181 |
| 3,718,086 | 2/1973 | Vertegaal | 101/120 X |
| 3,834,307 | 9/1974 | Zimmer | 101/115 |
| 3,886,861 | 6/1975 | Anselrode | 101/119 |
| 3,892,177 | 7/1975 | Giani | 101/115 X |
| 3,934,502 | 1/1976 | Marino | 101/116 X |
| 3,952,650 | 4/1976 | Lotte | 101/120 |

FOREIGN PATENT DOCUMENTS

| | | | |
|---|---|---|---|
| 1,285,553 | 8/1972 | United Kingdom | 101/115 |

*Primary Examiner*—Ronald E. Suter
*Attorney, Agent, or Firm*—Sughrue, Rothwell, Mion, Zinn and Macpeak

[57] ABSTRACT

A vertical rotary screen printing machine has a rotary printing cylinder in which is housed a combination dye dispensing bar and squeegee arrangement with which is associated a weir which controls dye flow.

The arrangement is adjustable, preferably bodily, (a) radially to effect variation in contact pressure between the squeegee and printing cylinder; and (b) rotatably to effect variation in the position of the line of contact of the squeegee relative to the printing cylinder.

12 Claims, 15 Drawing Figures

VERTICAL ROTARY SCREEN PRINTING MACHINE AND INK SUPPLY THEREFORE

This invention relates to a vertical rotary screen printing machine, and it is an object of the present invention to provide for such a machine an improved dye application arrangement.

There is thus provided according to the present invention a vertical rotary screen printing machine comprising a rotary printing cylinder housing a dye dispensing bar and squeegee arrangement with an associated weir for delivering dye to the cylinder wall for application therethrough to a fabric by the squeegee.

Embodiments of the present invention will now be described, by way of example, with reference to the accompanying drawings, in which.

Figures 1, 2, 8:
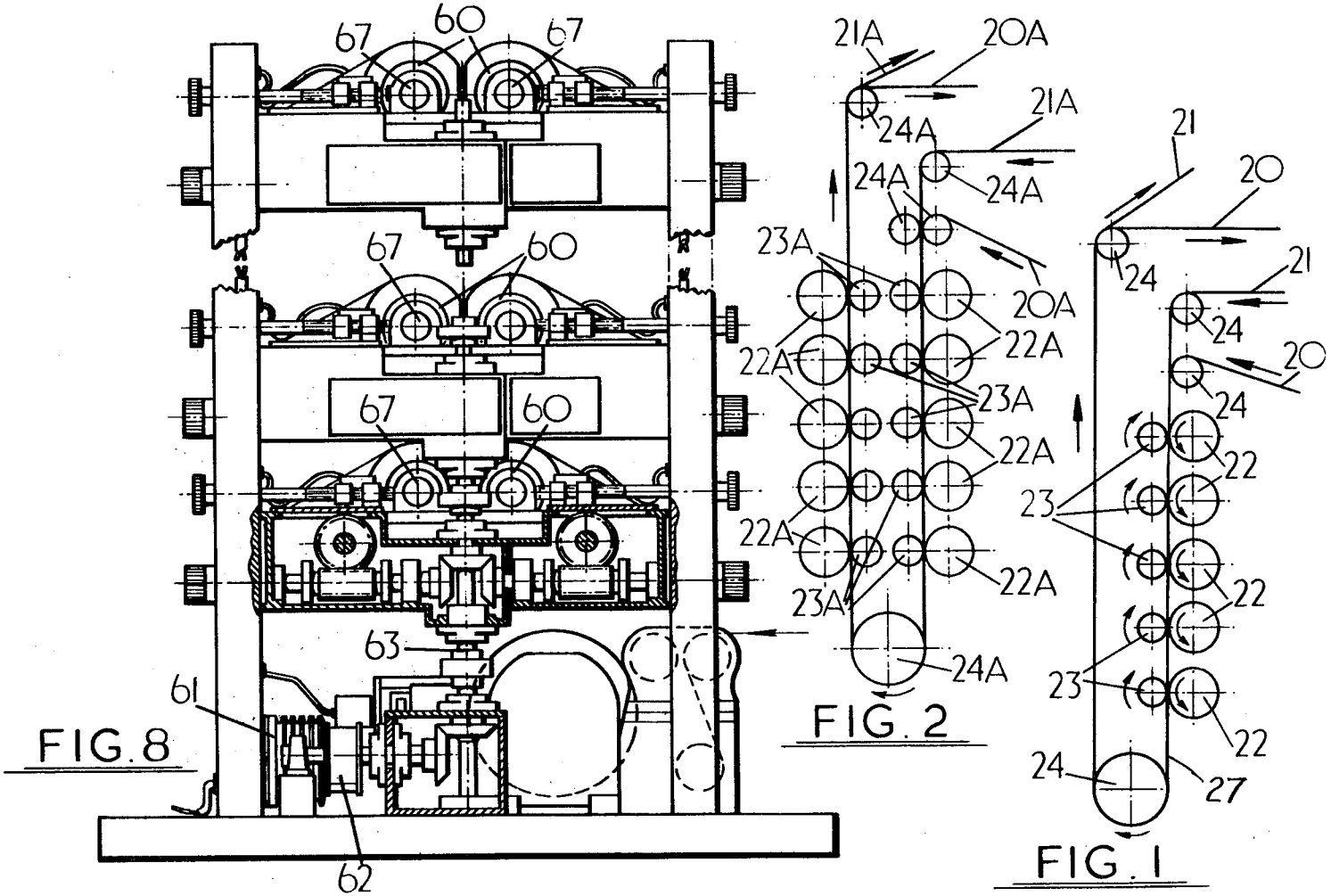
FIG. 1 is a diagrammatic view of a vertical rotary printing machine forming one embodiment of the present invention for printing one side of a fabric with five colours.
FIG. 2 is a diagrammatic view of a similar machine to that of FIG. 1, again for printing one side of a fabric but, in this instance, with ten colours.
FIG. 8 is a fragmentary part-sectional end view of a duplex machine forming yet another embodiment of the invention showing three printing platforms and part of the machine drive.

Reference is made firstly to FIG. 1, in which the fabric being printed is indicated at 20, it being moved through the machine by a driven endless conveyor 21 and the rotary perforated (wholly or partially) printing cylinders 22, there being, in this instance, five to print the fabric 20 with five colours. The fabric 20 is urged against the cylinders 22 by pressure rollers 23 of a resilient nature acting through the endless conveyor 21. Guide rollers 24 for the fabric 20 and endless conveyor 21 are indicated at 24, the endless conveyor 21 and fabric 20 forming a fabric/conveyor 27.

FIG. 2 shows a similar arrangement of FIG. 1 but in which the same side of the fabric is printed with ten colours, the first five being printed while the fabric is moving downwards and the second five while it is moving upwards. Those parts of the machine of FIG. 2 which are the same as parts of the machine of FIG. 1 are indicated by the same references with the suffix "A."

Each printing cylinder has an internal dye dispensing bar and squeegee arrangement and it is this with which the present invention is primarily concerned.

Figure 3:
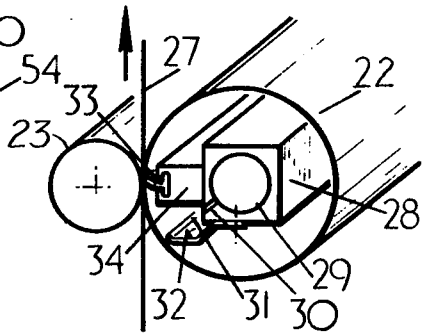
FIG. 3 is a diagrammatic view of a pressure roller and printing cylinder of the embodiment of FIG. 1, with the latter incorporating a dye dispensing bar and squeegee according to the present invention.

In FIG. 3, there is shown a printing cylinder 22, a pressure roller 23 and the fabric/conveyor is generally indicated by line 27.

The dye dispensing bar and squeegee arrangement comprises a hollow rectangular bar 28 through the bore 29 of which dye is pumped, the dye passing through metering passages 30 into a weir 31 defined by a plate 32 secured to the bar 28 along its bottom. The squeegee is a rubber or other elastometric or plastics blade 33 carried in a rail 34 appropriately secured to the surface of the bar 28 nearest the cylinder 25.

The contact pressure of the squeegee blade 33 on the cylinder 25 and the position of the line of contact of the squeegee blade 33 relative to the cylinder 25 is variable by, as will be described later, moving the arrangement 28 to 34 radially towards and away from the cylinder surface to increase or decrease the printing pressure (greater or lesser pressure pushing of dye through the cylinder into the fabric), and by pivoting it about its own axis so as to control the amount of dye egressing from the weir 31 for application to the fabric, e.g., if the arrangement is pivoted clockwise, the weir is tilted upwards and less dye flows thereout. The squeegee blade 33 also acts as a doctor blade to prevent any excess dye being carried therepast by the cylinder.

Figure 4:
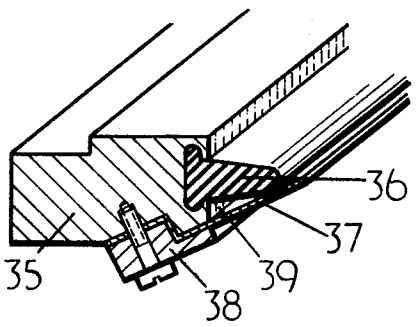
FIG. 4 is a fragmentary perspective view of a squeegee for association with a dye dispensing bar forming yet another embodiment of the invention.

FIG. 4 shows an alternative weir and squeegee arrangement comprising a rail 35 for attachment to a dye dispensing bar (not shown), a resilient squeegee blade 36, and a metal plate 37 secured to the rail 35 by a clamping bar 38 and defining below the squeegee blade 36 a weir 39.

Figure 5A:
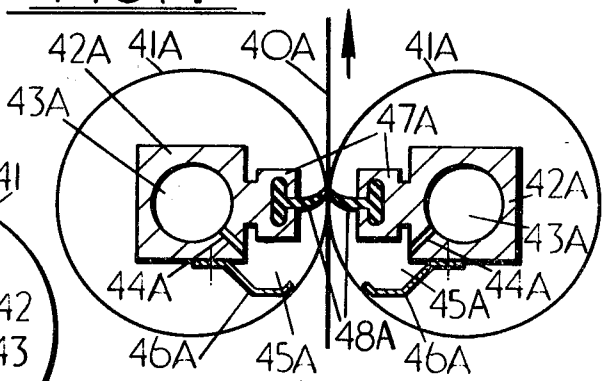
FIGS. 5 and 5A are diagrammatic views of a pair of printing cylinders with internal dye dispensing bars and squeegees according to other forms of the present invention such as would be employed on a duplex vertical rotary screen printing machine (both sides of a fabric printed simultaneously) for downward and upward printing respectively.
Figure 5:
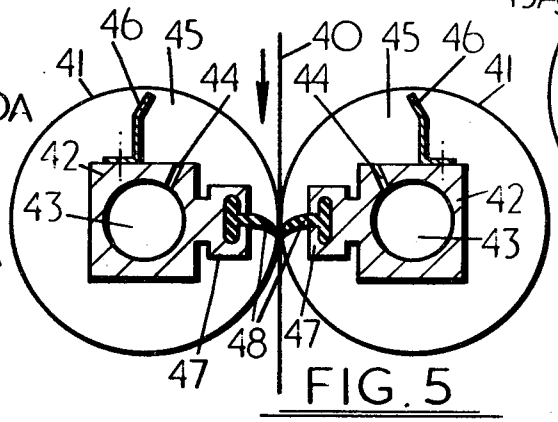

In FIG. 5, there is shown a preferred duplex printing arrangement for downward printing, i.e. two sides of fabric 40 printed simultaneously by two co-operating rotary printing cylinders 41. Each of the latter includes a hollow dye dispensing bar 42 with bore 43 and metering passages 44 feeding a weir 45 delimited by a plate 46 along the top of the bar 42. The bar 42 mounts a front rail 47 which, in turn, carries a resilient squeegee blade 48.

FIG. 5A shows a similar arrangement for upward printing with like parts having the same references with the suffix "A." In this instance, however, there is a bottom plate 46A defining a bottom weir 45A and the squeegee blades 48A are upturned due to upward fabric movement rather than downturned as in FIG. 5, wherein the fabric 40 is moving downwards.

Figure 6:
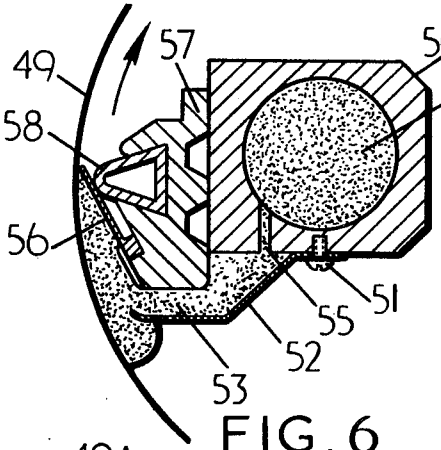
FIGS. 6 and 7 are alternative embodiments of dye dispensing bar and squeegee arrangements for upward and downward printing respectively.
Figure 7:
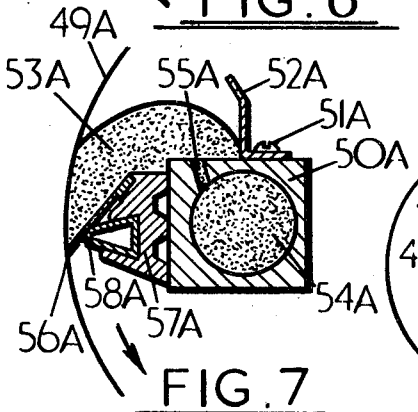

FIGS. 6 and 7 show a more sophisticated dye dispensing bar and squeegee arrangement for upward and downward printing respectively, i.e. fabric moving upwards in FIG. 6 and downwards in FIG. 7. For this reason parts shown in FIG. 7 which are the equivalent to parts in FIG. 6 have the same references with the suffix "A." Only FIG. 6 will be described in detail.

In FIG. 6, the rotary printing cylinder is indicated at 49. The hollow dispensing bar 50 has secured to its bottom (top in FIG. 7) by screws 51 a plate 52 defining a weir 53. Metering passages between the bore 54 of the bar 50 and the weir 53 are indicated at 55.

The squeegee, in this instance, is a metal blade 56 carried by a rail 57 conveniently secured to the bar 50. The rail 57 also carries an inflatable cushion 58 which acts on the blade 56 to increase or decrease the printing pressure depending on the degree of inflation of the cushion 58.

It is to be noted that each of the abovedescribed dye dispensing bar and squeegee arrangements has associated with it a sensing means (not shown) for controlling the dye supply pump which is reversible, and thereby the quantity of dye available for printing.

The remainder of the description is concerned with the preferred duplex vertical screen printing machine but it is to be understood that certain references are applicable also to single-sided printing machines. Where convenient, a dye dispensing bar and squeegee arrangement will hereafter simply be called "a squeegee."

Figure 9:
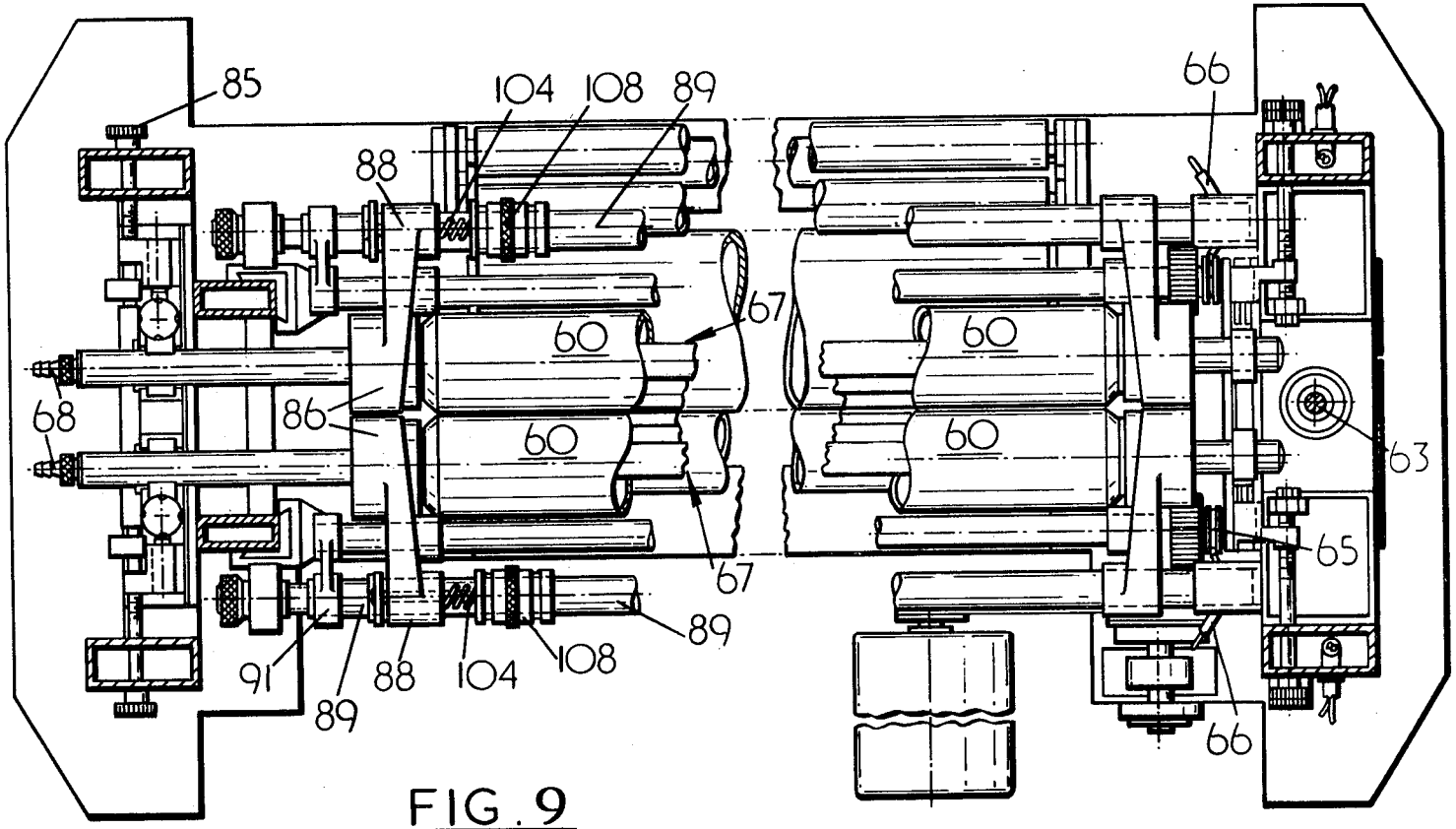
FIG. 9 is a plan view of a printing platform of the duplex machine of FIG. 8.
Figure 11:
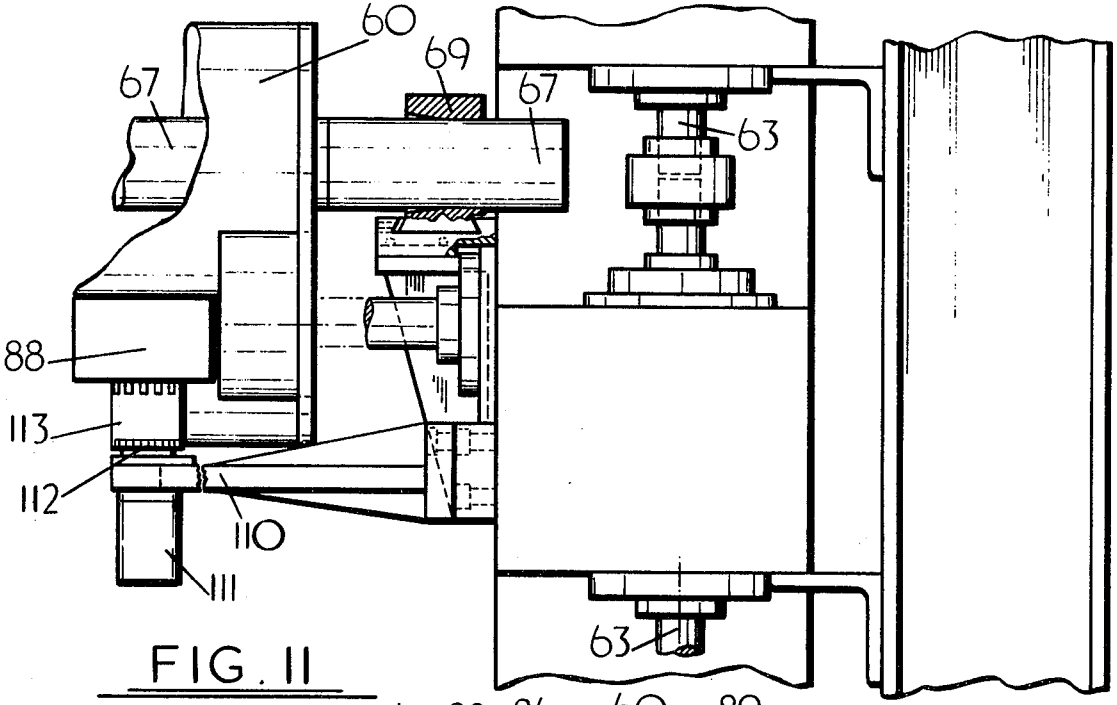
FIG. 11 is a fragmentary front view of one end of a printing cylinder and dispensing dye bar according to the embodiment of the invention of FIG. 8.
Figure 10:
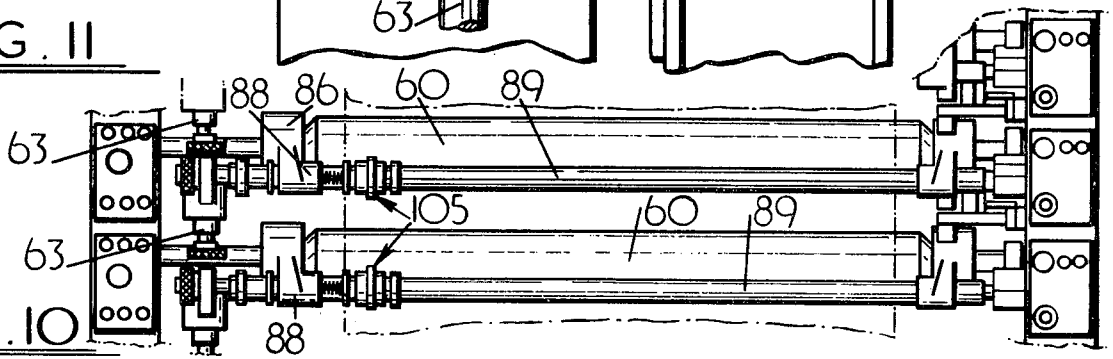
FIG. 10 is a fragmentary front view of the duplex machine of FIGS. 8 and 9.

The rotary printing cylinders, hereafter referred to by reference 60, are rotated from a common drive motor 61 and gear reduction 62 via a common vertical shaft 63 at one end of the machine (see especially FIGS. 8 to 10). Drive is transmitted from the shaft 63 to each cylinder 60 by appropriate gearing and a clutch 65 with manually-operable lever 66 interposed in the drive arrangement to permit disconnection between drive shaft 63 and cylinders 60.

Squeegees are generally indicated at 67 with dye inlets at 68.

As mentioned above, a squeegee 67 is radially movable relative to its printing cylinder 60 and is rotatable about its own axis.

A printing cylinder 60 is also subject to certain movements. Firstly, its ends can be independently vertically adjustable, i.e. it can be slewed in a vertical plane — this is important for registration purposes since it provides parallelism between co-operating cylinders. Secondly, it is pivotal about an axis parallel with its own axis which again serves to ensure accurate registration between co-operating cylinders and also allows different fabric thicknesses to be accommodated. Thirdly, it can move axially horizontally, again for registration purposes.

The squeegee and its cylinder has a co-operative inter-locked movement necessitated by the pivotting movement of the cylinder. In this case, it is essential for the squeegee to retract horizontally from the cylinder surface just prior to pivotting of the cylinder since otherwise the relatively fragile surface of the cylinder would be damaged by the not insubstantial squeegee.

We shall deal firstly with the independent squeegee movements.

Figure 12:
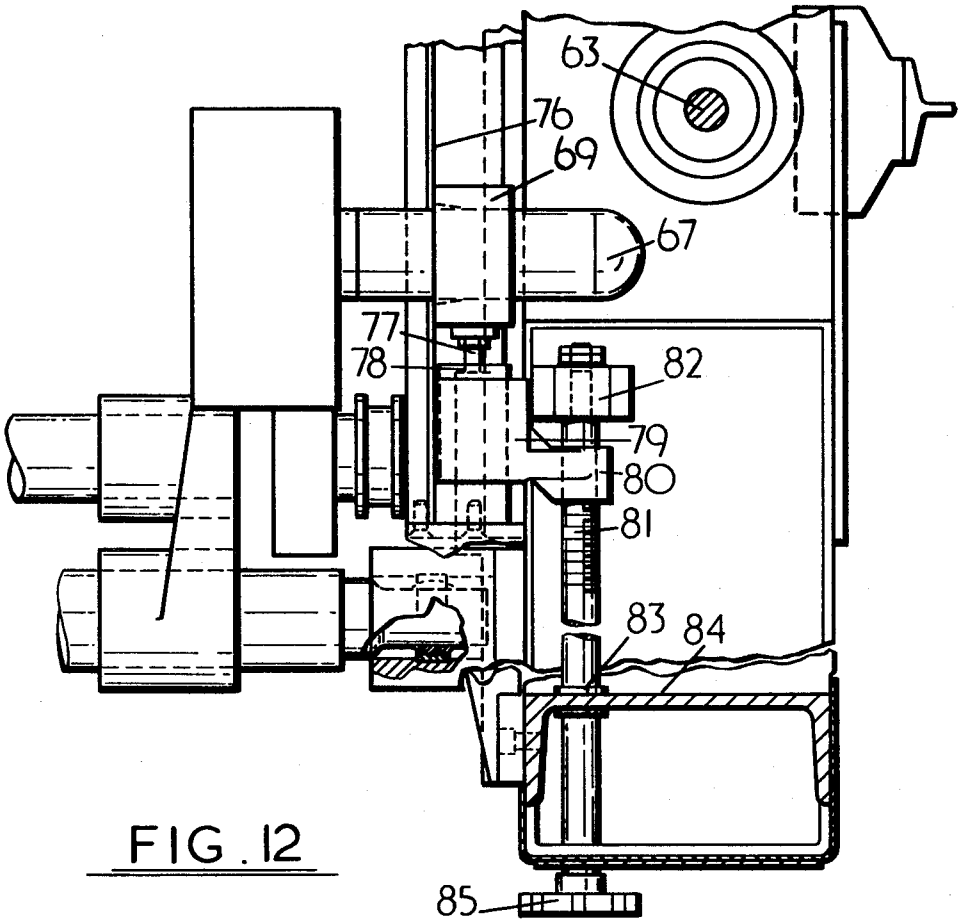
FIG. 12 is a fragmentary plan view of the same end of the apparatus of FIG. 11.
Figure 13:
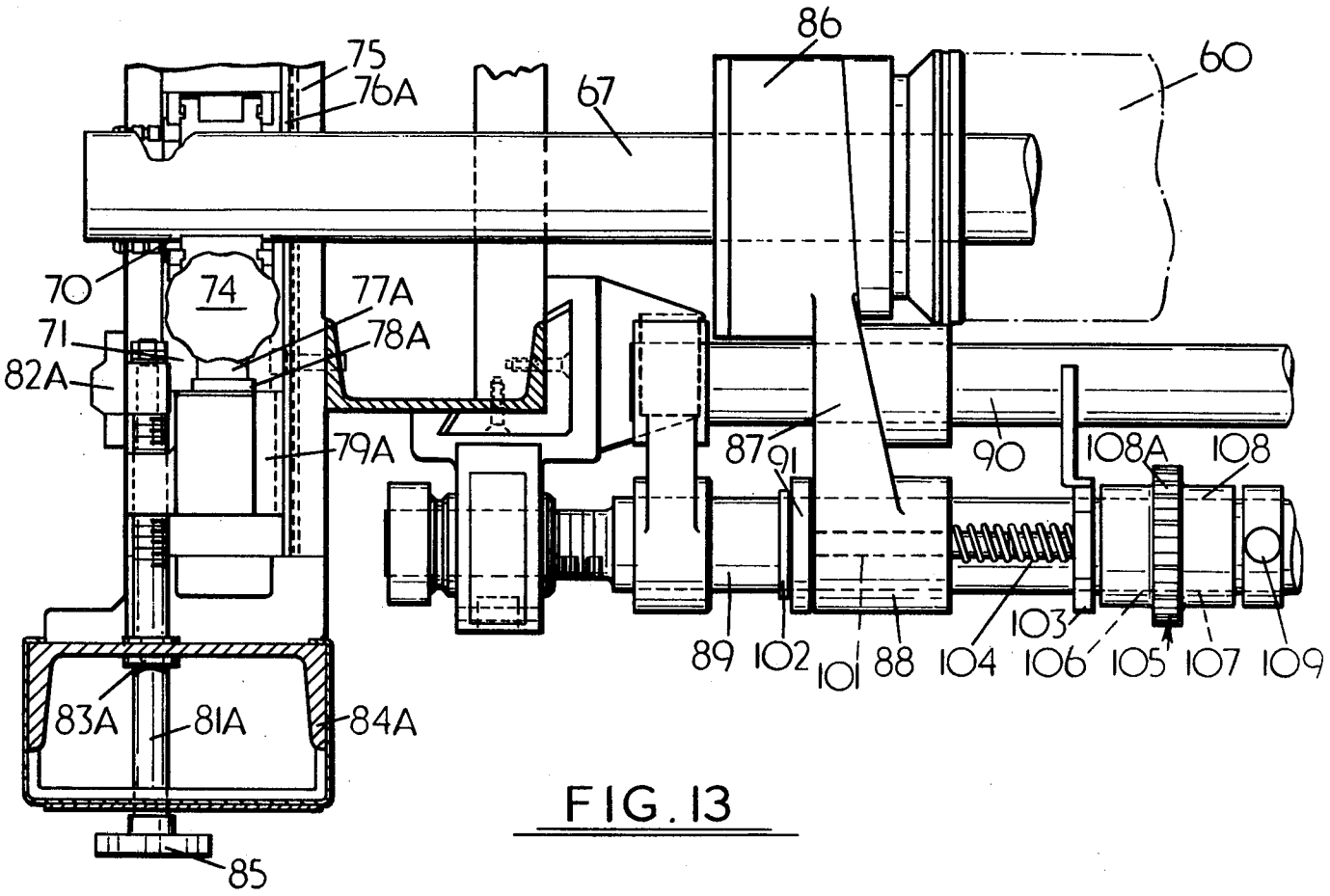
FIG. 13 is a fragmentary front view of the other end of the embodiments of FIG. 11.
Figure 14:
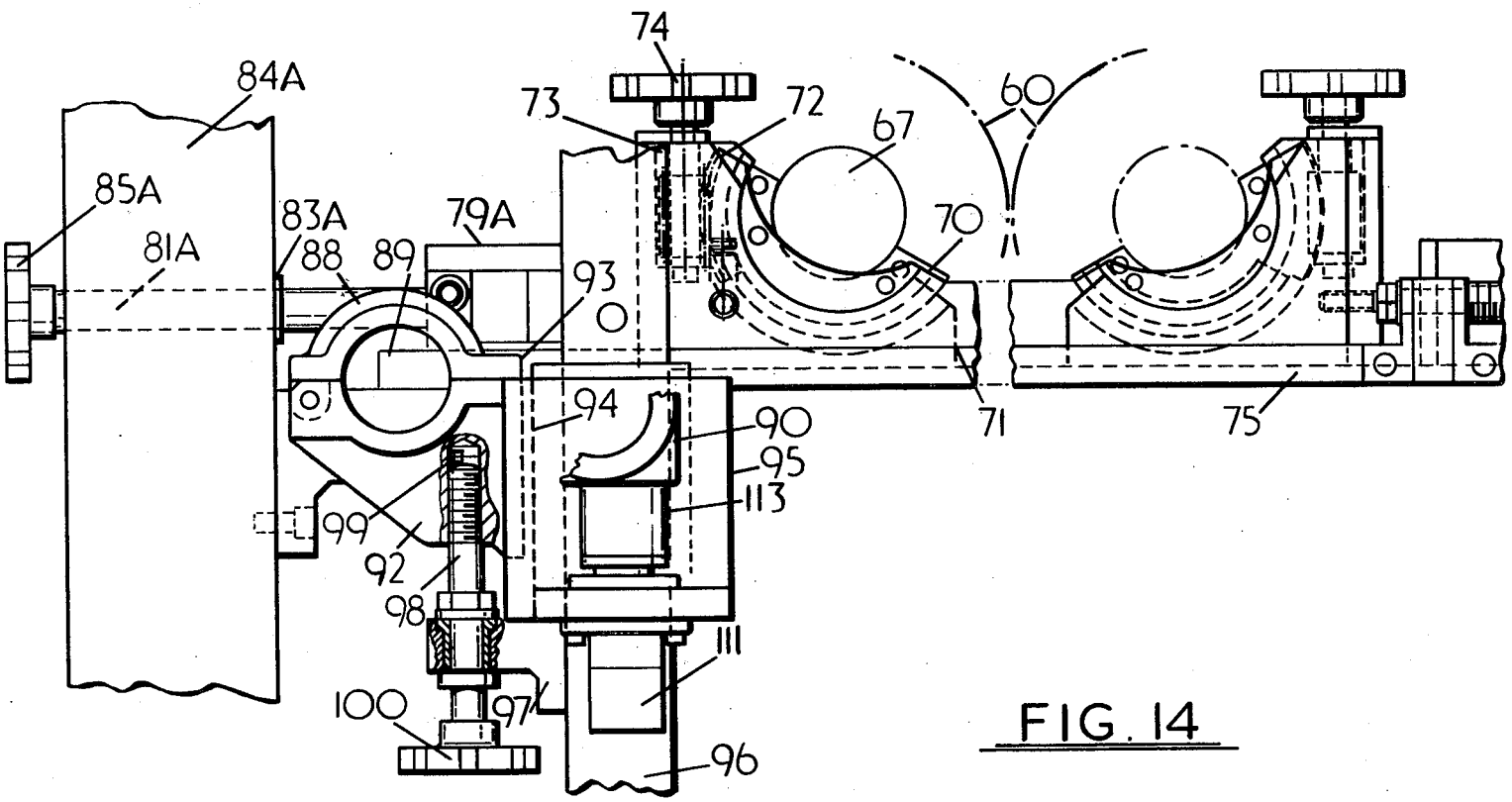
FIG. 14 is a detailed end view of one printing platform of the duplex machine of FIG. 8 according to the invention.

Each squeegee 67 is rotatably supported at one end in an annular bearing 69 (FIG. 12) and at its other end is clamped in a section 70 rotatably supported in a half-annular bearing 71 (FIGS. 13 and 14). The sector 70 is geared as indicated at 72 and a vertical worm 73 is carried by the half-annular bearing 71 in mesh with the gearing 72, the worm 73 having a top knob or handle 74 to permit rotation of the worm 73 and section 70 and so pivotting of the squeegee about its own axis. A scale (not shown) is provided in each half-annular bearing 71 to ensure accurate pivotal setting of the squeegee 67.

Each bearing 69 and each half-annular bearing 71 of each squeegee 67 of each cylinder 60 is slidable along a platform 75 of the machine. For convenience, we shall describe only the bearing 69 end of the squeegee 67 and similar parts at the other end having the same references with the suffix "A." The bearing 69 is slidable in a guideway 76 in the platform 75. The bearing 69 is connected by a rod 77 to a piston (not shown) in a rectangular-section, double-acting pneumatic cylinder 78 which, in turn, is supported in a carrier block 79 also slidable in the guideway 76. The carrier block 79 has a lateral extension in the form of a nut 80 which is screw-engaged by a screw-rod 81 rotatable at one end in a bearing 82 on the platform 75 and a bearing 83 in a vertical pillar 84 of the machine frame. The other end of the screw rod 81 has a knob or handle 85. It will be manifest that rotation of the two knobs 85, 85A of a squeegee 66 will effect movement of carrier blocks 79, 79A and bearing 69 and half-annular bearing 71 along guideways 76, 76A to move the squeegee radially towards or away from the cylinder surface.

Each cylinder 60 (see FIGS. 13 and 14) is supported adjacent each of its ends in a large-diameter bearing 86 having an integral arm 87 with, at its free end, a bearing 88 which rotatably and axially embraces a shaft 89. The arms 87 are traversed by another shaft 90 which is connected to shaft 89 by three equally-spaced arms 91. The shaft 89 is rotatably mounted and axially movable in end bearings 92. Each end bearing 92 has a key formation 93 engaging in a slideway 94 in a block 95 secured to another vertical pillar 96 of the machine frame. Below each end bearing 92 and fast with the pillar 96 is a horizontal plate 97 in which is fast a rotatable screw row 98 screw-engaging in a screw bore 99 of the bearing 92 and having at its bottom a knob or handle 100. It will be manifest that rotation of the knobs 100 will permit correction of any non-parallelism of the cylinder.

Each cylinder 60 is also axially movable relative to shafts 89 and 90 for horizontal registration purposes (see FIG. 13). One of the bearings 88 is traversed above and below the shaft 89 by a rod 101, the rods 101 being connected between two plates 102 and 103 fast with and traversed by the shaft 89. The bearing 88 abuts plate 102 and is urged thereagainst by springs 104 surrounding rods 101 and acting between the plate 103 and the bearing 88. The shaft 89 is axially split at 105 and has two oppositely-handed screw-threaded portions 106 and 107 screw-engaged by a nut 108 having a lock screw 109 which releasably engages the shaft 89 to prevent inadvertent rotation. The nut 108 has a knurled ring 108A to facilitate rotation thereof.

It will be manifest that, depending on the direction of rotation of the nut 108 after release of the lock screw 109, the screw-threaded portions 106 and 107 of the split shaft 89 will be moved towards or away from each other thus causing axial movement of the adjacent bearing 88 and consequently via the arm 87 and bearing 86 the cylinder 60.

It should be noted that the arm 91 each carries at its free end a freely-rotatable roller (not shown) on which the corresponding cylinder 60 rests. Manual pivoting of cylinders 60 towards or away from one another for accurate registration or to accommodate different fabric thicknesses may be thus effected.

Pivotting of the cylinders 60 is effected pneumatically. A horizontal support 110 is provided for each cylinder 60 at each end of the machine and mounts a (single acting) pneumatic vertical cylinder 111 which moves a piston 112 slidable in a tubular casing 113 on which rests the arms 91 where they are traversed by shaft 89. The casing 113 is vertically screw-adjustable to mechanically secure the arms 91 and consequently the cylinder 60 in adjusted position on release of the piston 112. The cylinder 60 is thus pneumatically supported while being pivoted and is mechanically held when adjusted.

The pneumatic circuitry and valving (not shown) is such that prior to cylinder 111 being supplied with air, cylinders 78 are supplied to effect movement of the squeegee 67, bearing 69 and half-annular bearing away from the cylinder 60 before pneumatic pivotting of the latter.

Control panels for each cylinder are indicated at 114.

What we claim is:

1. A rotary screen printing machine comprising; a frame including a plurality of screen printing cylinders, means for superimposing said printing cylinders in a vertical arrangement one above another on said frame; a dye dispensing bar and squeegee arrangement extending through each said printing cylinder and including a hollow bar extending therethrough and projecting beyond the ends thereof; spaced platforms for said each cylinder; a first bearing slidably mounted on one said platform and rotatably mounting one end of said hollow bar; a second bearing slidably mounted on the other said platform and mounting the other end of the hollow bar; a squeegee blade mounted along the hollow bar for contact with the internal surface of the corresponding printing cylinder; a plate supported along the hollow bar to define with the squeegee blade a dye liquor weir in communication with the hollow bar interior via metering passage means; means connected to one of said ends of the hollow bar for controllably feeding dye liquor into the hollow bar interior and from thence via said metering passage means and weir to the printing cylinder internal surface; means on each said platform and connected to each bearing for sliding the latter along the platforms radially towards or away from the internal surface of its corresponding printing cylinder to vary the contact pressure between the squeegee blade and each said printing cylinder and adjustment means interconnecting the second bearing and the hollow bar for pivoting the hollow bar about its own axis and locking the same in adjusted angular position to thereby control the amount of dye liquor egressing from the weir radially towards the corresponding printing cylinder internal surface.

2. A machine as claimed in claim 1 wherein each said squeegee blade comprises a metal blade and wherein said machine further comprises an inflatable cushion carried by said hollow bar in contact with said blade such that, upon inflation of said inflatable cushion, each said blade is urged against its corresponding printing cylinder internal surface.

3. A machine as claimed in claim 1 further comprising vertical slideways carried by said platforms, carrier blocks movably mounted within said slideways, double-acting fluid cylinders carried in said carrier blocks, said first and second bearings being connected to said pistons of said double-acting fluid cylinder and screw means for effecting carrier block movement within said slideways.

4. A machine as claimed in claim 3 in which the screw means is a manually operable screw rod, which screw rod engages a nut integral with the carrier block.

5. A machine as claimed in claim 1 in which gearing is provided to effect rotation of the hollow bar, said gearing comprising a manually operable worm enmeshed with a geared section at the second bearing end of said hollow bar.

6. A machine as claimed in claim 1 further comprising a shaft extending parallel to each said cylinder axis and arms rotatably and axially mounted on said shaft for pivotally supported each said printing cylinder.

7. A machine as claimed in claim 6 further comprising a guideway mounted bearing slidable vertically within a guideway for carrying each said shaft to permit parallelism of each said cylinder.

8. A machine as claimed in claim 7, further comprising screw means acting on said guideway mounted bearing of each said shaft.

9. A machine as claimed in claim 7, further comprising cylinders fixed to said frame and engaging said arms to effect pivotal movement of each said printing cylinder.

10. A machine as claimed in claim 6, further comprising means for mounting said arms and each said cylinder such that each said cylinder is axially movable relative to said shaft.

11. A machine as claimed in claim 10, wherein said shaft is axially split and comprises adjacent-oppositely threaded screwed portions operatively associated with a nut releasably secured against rotation but which, when rotated, increases or decreases shaft length to move one of each said cylinder carrying arms so that the latter and the cylinder slide along the shaft.

12. A machine as claimed in claim 6, further comprising fluid cylinders fixed to said frame and engaging said arms to effect pivotal movement of each of said printing cylinder.

* * * * *